US008419095B2

(12) United States Patent
McAfee

(10) Patent No.: US 8,419,095 B2
(45) Date of Patent: Apr. 16, 2013

(54) PALLET SYSTEM AND METHOD FOR USE THEREOF

(75) Inventor: Ralph Glenn McAfee, La Plata, MD (US)

(73) Assignee: Clark Construction Group, LLC, Bethesda, MD (US)

( * ) Notice: Subject to any disclaimer, the term of this patent is extended or adjusted under 35 U.S.C. 154(b) by 0 days.

(21) Appl. No.: 13/217,514

(22) Filed: Aug. 25, 2011

(65) Prior Publication Data

US 2012/0048155 A1 Mar. 1, 2012

Related U.S. Application Data

(60) Provisional application No. 61/402,178, filed on Aug. 25, 2010.

(51) Int. Cl.
*B66C 1/00* (2006.01)

(52) U.S. Cl.
USPC ..... 294/67.4; 108/55.5

(58) Field of Classification Search ..... 294/67.4, 294/67.41, 81.55; 105/425, 435, 422; 108/55.5
See application file for complete search history.

(56) References Cited

U.S. PATENT DOCUMENTS

| | | | | |
|---|---|---|---|---|
| 2,886,367 | A * | 5/1959 | Montanino | 294/67.4 |
| 2,933,339 | A | 4/1960 | Alvden | |
| 3,065,987 | A | 11/1962 | Elsner et al. | |
| 3,239,265 | A | 3/1966 | Scibilia | |
| 3,827,744 | A | 8/1974 | Ferdelman et al. | |
| 3,876,099 | A | 4/1975 | Land | |
| 4,278,395 | A | 7/1981 | Thunell | |
| 4,550,940 | A * | 11/1985 | Schweikert | 294/67.4 |
| 5,329,862 | A | 7/1994 | Breezer et al. | |
| 6,622,640 | B2 | 9/2003 | Taylor et al. | |
| 6,957,613 | B2 | 10/2005 | Taylor et al. | |
| 7,810,861 | B1 * | 10/2010 | Heinrichs | 294/67.4 |

* cited by examiner

*Primary Examiner* — Saul Rodriguez
*Assistant Examiner* — Gabriela Puig
(74) *Attorney, Agent, or Firm* — Martin & Ferraro, LLP

(57) ABSTRACT

A pallet having a base and a locking assembly for securing a hoisting cable to the pallet with a removable locking member, and a method for use thereof.

20 Claims, 6 Drawing Sheets

FIG. 8
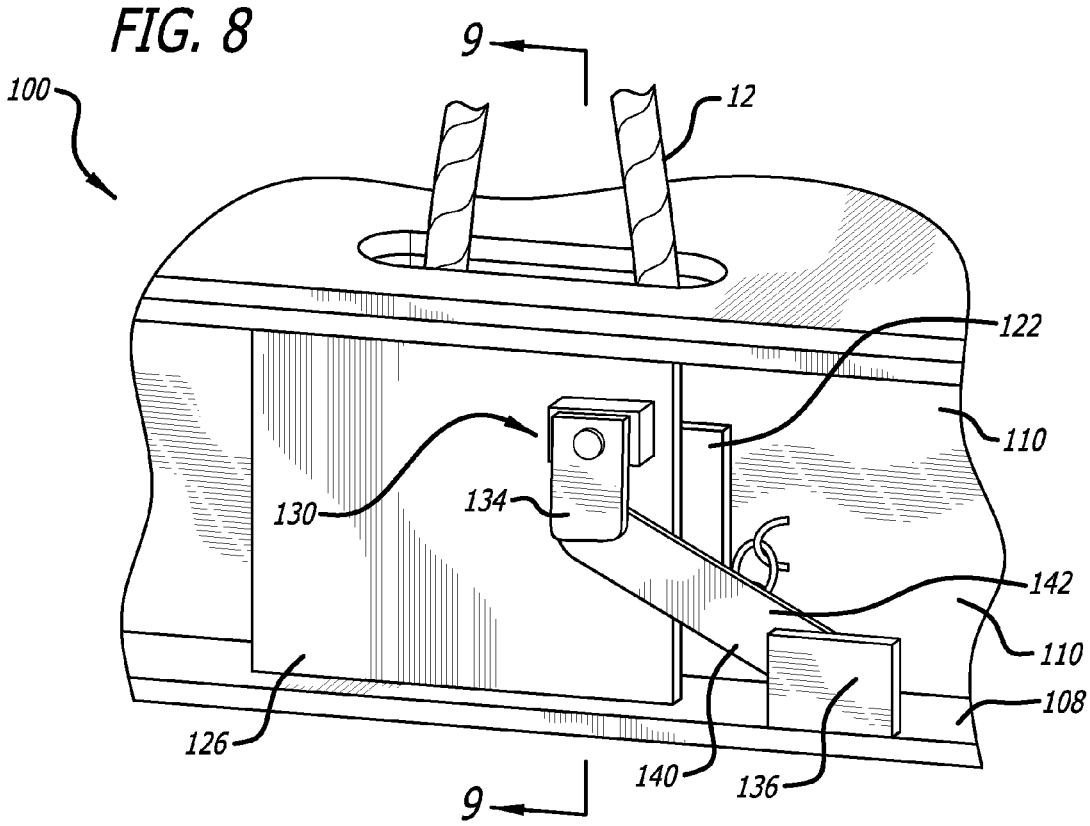
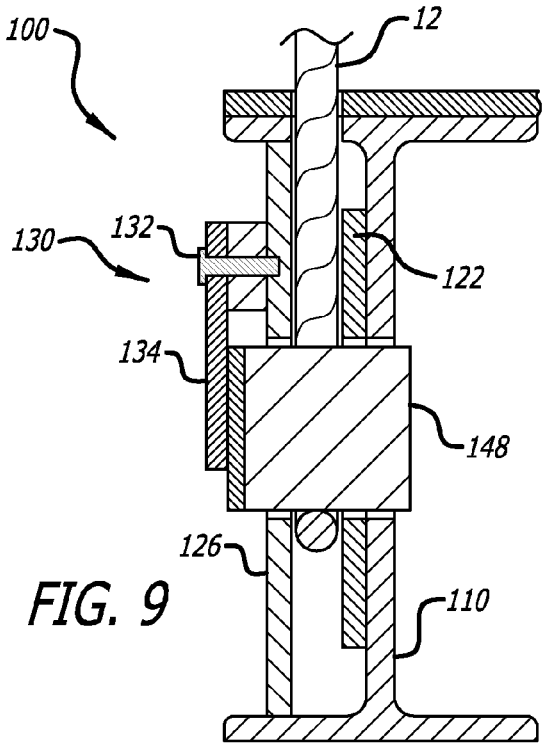
FIG. 9

PALLET SYSTEM AND METHOD FOR USE THEREOF

RELATED APPLICATIONS

This application claims the benefit of U.S. Provisional Application No. 61/402,178, filed Aug. 25, 2010, entitled "Pallet System and Method For Use Thereof," the entire contents of which is hereby incorporated by reference herein.

BACKGROUND OF THE INVENTION

1. Field of the Invention

The present invention is generally related to a pallet system for facilitating movement of a load using different equipment such as semi-trailers, forklifts, and cranes. In particular, the pallet system of the present invention preferably includes a pallet having features permitting engagement with semi-trailers, forklifts, and cranes. More specifically, the pallet system of the present invention in a preferred embodiment includes a pallet having cable locking systems for securing thereto cables depending downwardly from a crane.

2. Description of the Prior Art

Materials used on construction jobsites require both transport to the jobsite and transport to various locations on the jobsite. Typically, the materials can be transported to the jobsite on pallets by semi-trailers. Thereafter, the materials can be transported to various ground locations on the jobsite by forklifts. However, transport of the materials to various above-ground locations requires use of cranes. Thus, a platform permitting manipulation thereof by cranes is typically used. Use of such a platform requires that the pallet is loaded onto the platform, or the materials are moved from the pallet onto the platform. Regardless of which way is used, time is lost.

Therefore, there is a need for a pallet system employing a pallet permitting engagement with semi-trailers, forklifts, and cranes. In addition to features permitting engagement with semi-trailers and forklifts, a pallet of such a pallet system preferably includes assemblies for retaining cables depending downwardly from a crane so that the pallet can be moved by the crane.

SUMMARY OF THE INVENTION

The present invention in one preferred embodiment includes a pallet configured for hoisting by a plurality of cables. The pallet includes a base having a top, a bottom opposite the top, and at least one side connecting the top and bottom. The side includes at least one aperture configured to receive a prong of a forklift; and a locking assembly including a lock attached to the base for locking one of the cables to the pallet. The lock requires an element of rotation to lock the cable to the pallet.

In another preferred embodiment, the present invention includes a pallet configured for hoisting by a plurality of cables. The pallet includes a base having a top, a bottom opposite the top, a front surface, a rear surface opposite the front surface, and opposed side surfaces, each of the side surfaces connecting the front and rear surfaces with the top and bottom to form the base. The front and rear surfaces include at least one aperture configured to receive a prong of a forklift. The pallet includes a locking member having a portion configured for removable engagement with the base. The removable portion of the locking member forms an attachment point about which the cable attaches to the pallet.

In a further preferred embodiment, the present invention includes a method for hoisting a pallet. The method includes positioning the pallet with a fork lift to a location for subsequent lifting of the pallet by a hoist having a plurality of cables, each cable including an end with a loop; attaching each cable to the pallet by inserting a locking member through the end loop of the cable and into the pallet to secure each cable to the pallet; and hoisting the pallet once the cables have been secured to the pallet.

It is understood that both the foregoing general description and the following detailed description are exemplary and exemplary only, and are not restrictive of the invention as claimed.

BRIEF DESCRIPTION OF THE DRAWINGS

The accompanying drawings, which are incorporated in and constitute a part of the specification, illustrate preferred embodiments of the invention. Together with the description, they serve to explain the objects, advantages and principles of the invention.

FIG. 8 is an enlarged partial perspective view of the locking assembly of FIG. 6 in an engaged position relative to the cable with the removable locking member engaged with a fixed plate.

FIG. 9 is a partial cross sectional side view of the locking assembly taken along lines 9-9 of FIG. 8.

DETAILED DESCRIPTION OF THE PREFERRED EMBODIMENT

The following description is intended to be representative only and not limiting, and many variations can be anticipated according to these teachings. Reference will now be made in detail to the preferred embodiments of this invention, examples of which are illustrated in the accompanying drawings.

Figure 1:
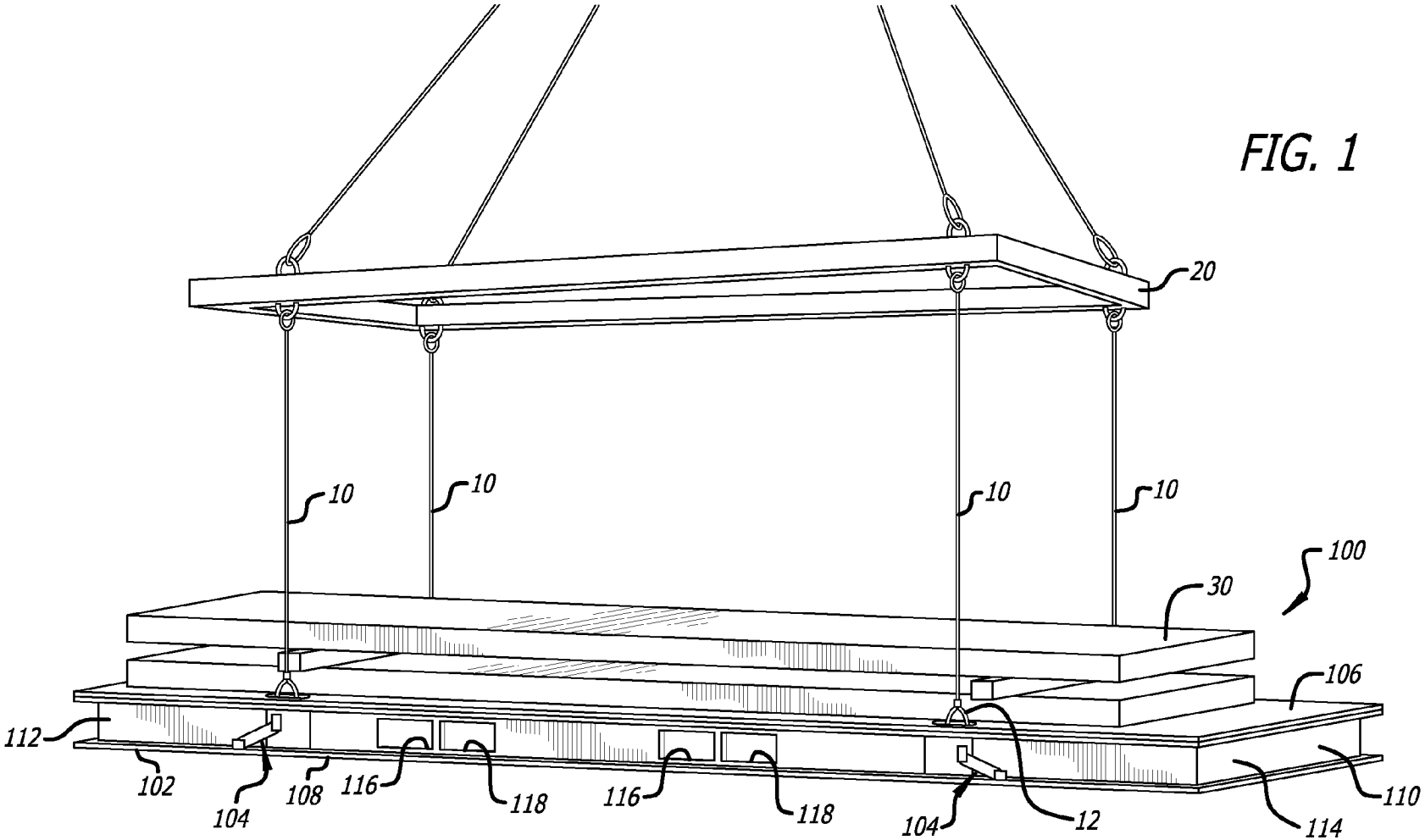
FIG. 1 is a perspective view of a pallet system having locking assemblies engaged with cables of a boom in accordance with one preferred aspect of the present invention.

FIGS. 1 to 5 show a pallet 100 having a base 102 and a locking assembly 104 for locking a cable 10 thereto. Referring to FIG. 1, in one preferred embodiment, a loop 12 at the end of each cable 10 is inserted into the pallet and engaged by a portion of locking assembly 104 to secure the cable to the pallet. Boom 20 may then hoist pallet 100, along with any cargo 30 thereon, to a desired location.

Figure 4:
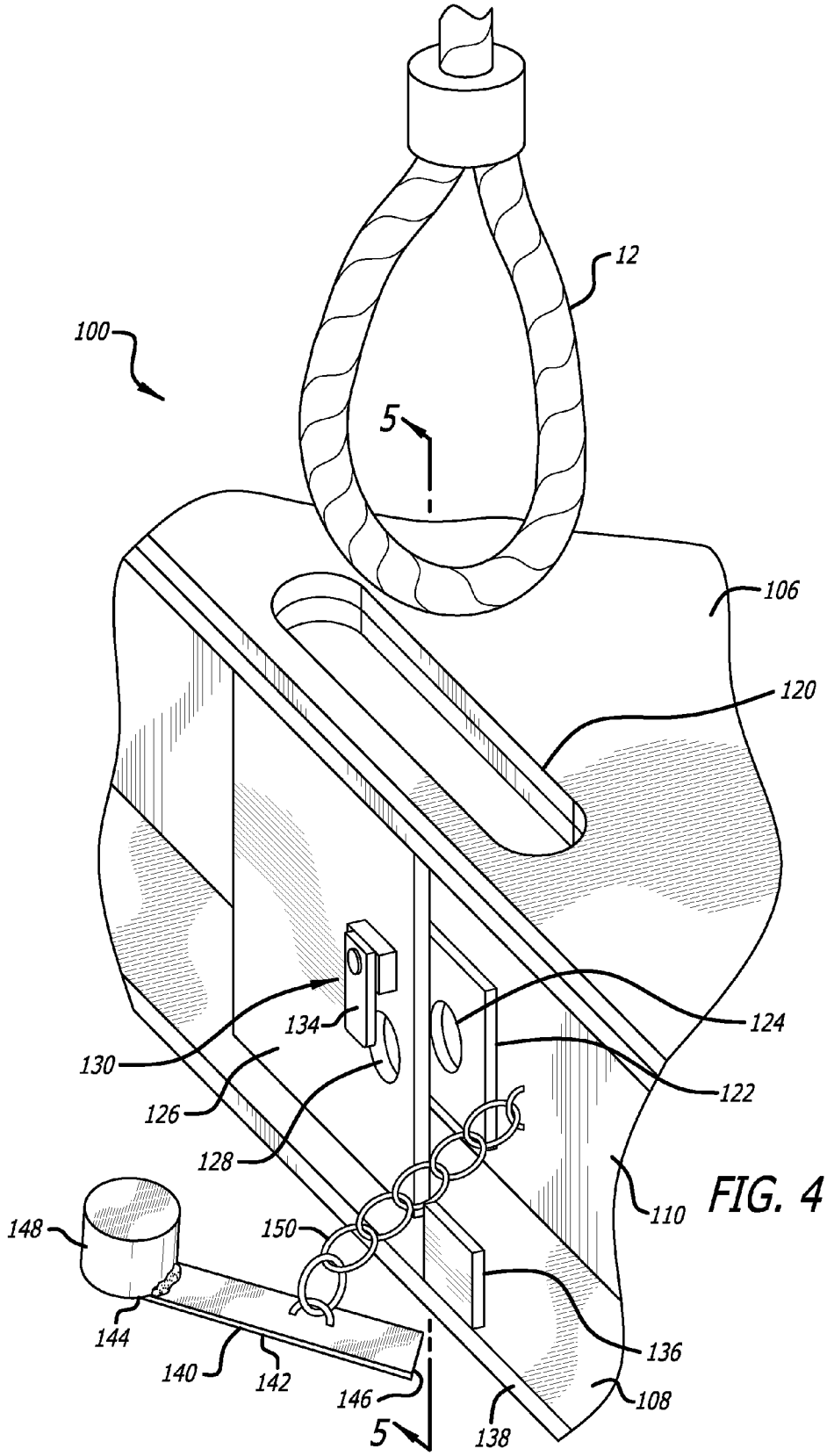
FIG. 4 is an enlarged partial perspective view of the locking assembly of FIG. 2 with the removable locking member disengaged from a base of the pallet.
Figure 5:
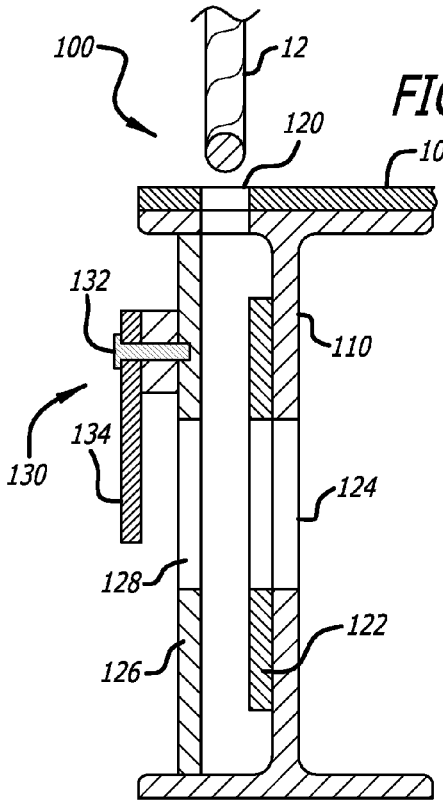
FIG. 5 is a partial cross sectional side view of the locking assembly taken along lines 5-5 of FIG. 4.

As shown in FIGS. 1, 2, 4 and 5, base 102 has a top 106, a bottom 108, and a sidewall 110. Sidewall 110 forms a front 112, a rear and opposed sides 114. Base 102 preferably includes a pair of apertures 116, 118 sized and configured for receiving the prongs of a forklift, and a slot 120 sized and configured for receiving loop 12 of cable 10. As shown in FIG. 5, sidewall 110 is preferably inset relative to the outer edges of top 108 and bottom 108.

Referring to FIGS. 4 and 5, locking assembly 104 preferably includes a first vertical plate 122 having an aperture 124, and a second vertical plate 126 having an aperture 128. Apertures 124, 128 are preferably coaxially aligned. First vertical plate 122 is preferably welded onto sidewall 110 to form a reinforced engagement point for the insertion of a portion of locking assembly 104 through apertures 124, 128, described in further detail below.

Second vertical plate 126 is preferably spaced apart and parallel to first vertical plate 122 to form a cavity therebetween. Preferably, second vertical plate 126 extends from bottom 108 to top 106. The space between first and second vertical plates 122, 126 is preferably aligned with slot 120 so that loop 12 of cable 10 may be inserted into the pallet and aligned with apertures 124, 128 of first and second vertical plates 122, 126, respectively.

As shown in FIGS. 4 and 5, second vertical plate 126 preferably includes a movable latch 130. Movable latch 130 preferably includes a fastener 132 for connecting a face plate 134 to second vertical plate 126. In use, movable latch 130 is rotatable about fastener 132 to move face plate 134 over at least a portion of aperture 128.

Figure 2:
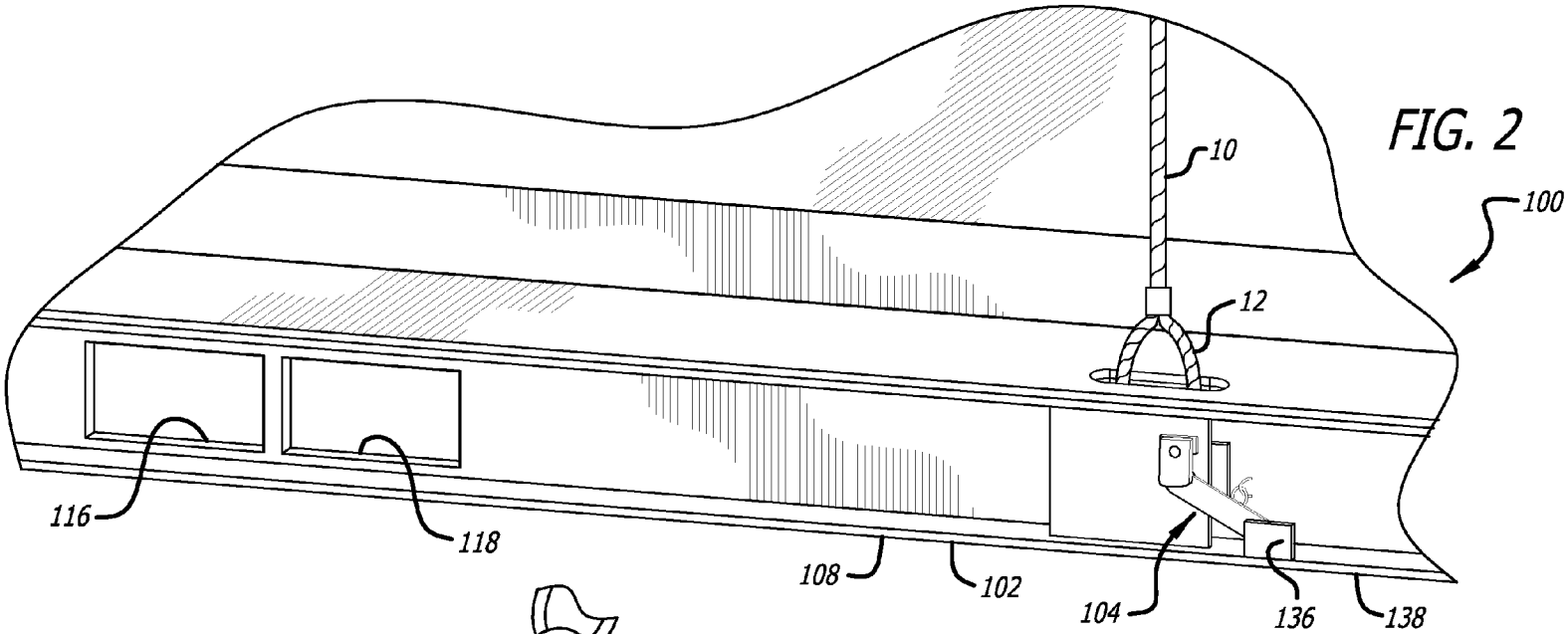
FIG. 2 is an enlarged partial perspective view of one of the locking assemblies of FIG. 1 having a removable locking member engaged with a cable.

Referring to FIGS. 2 and 4, locking assembly 104 further preferably includes a third vertical plate 136 extending from edge 138 of bottom 108. Third vertical plate 136 is preferably spaced apart and parallel to sidewall 110, and preferably spaced apart from second vertical plate 126. The recess formed between sidewall 110 and third vertical plate 136 is preferably generally perpendicular to the central longitudinal axis of each of apertures 124 and 126. Preferably, third vertical plate 136 is flush with edge 138 of bottom 108, while second vertical plate 126 is inset from edge 138.

Figure 3:
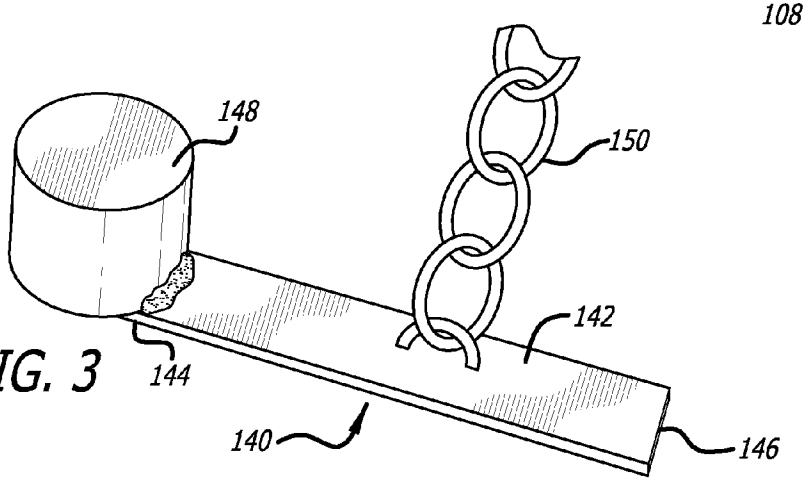
FIG. 3 is an enlarged perspective view of the removable locking member of FIG. 2.

FIGS. 3 and 4 show a removable locking member 140 for engagement with apertures 124, 128 of first and second vertical plates 122, 126, respectively. Removable locking member 140 preferably includes an arm 142 with a first end 144 and a second end 146. First end 144 preferably includes a peg 148 sized and configured for sliding into apertures 124, 128 of first and second vertical plates 122, 126, respectively. In order to minimize the risk of removable locking member 140 being misplaced, a chain 150 preferably connects removable locking member 140 to sidewall 110.

Having described the preferred components of pallet 100, a preferred method of use will now be described with reference to FIGS. 1 and 6 to 9. To facilitate use of semi-trailers and forklifts to move pallet 100, apertures 116, 118 extend through pallet 100 from one side thereof to the other side thereof, and facilitate engagement with semi-trailers and/or forklifts. When pallet 100 is placed on a semi-trailer, one or more of the apertures can serve to receive tie-downs (or cables) therethrough. As such, pallet 100 can be secured to the semi-trailer using tie-downs (or cables) passed through apertures 116, 118 and attached to the semi-trailer. As set forth above, apertures 116, 118 preferably serve to receive forks of a forklift. For example, to remove pallet 100 from the semi-trailer, the tie-downs (or cables) are removed from the one or more of apertures 116, 118. Thereafter, the forks of the forklift are inserted into apertures 116, 118. The forklift is then used to remove pallet 100 from the semi-trailer and transport pallet 100 to a particular destination for subsequent lifting of the pallet by a hoist with a plurality of cables, shown in FIG. 1.

Figure 6:
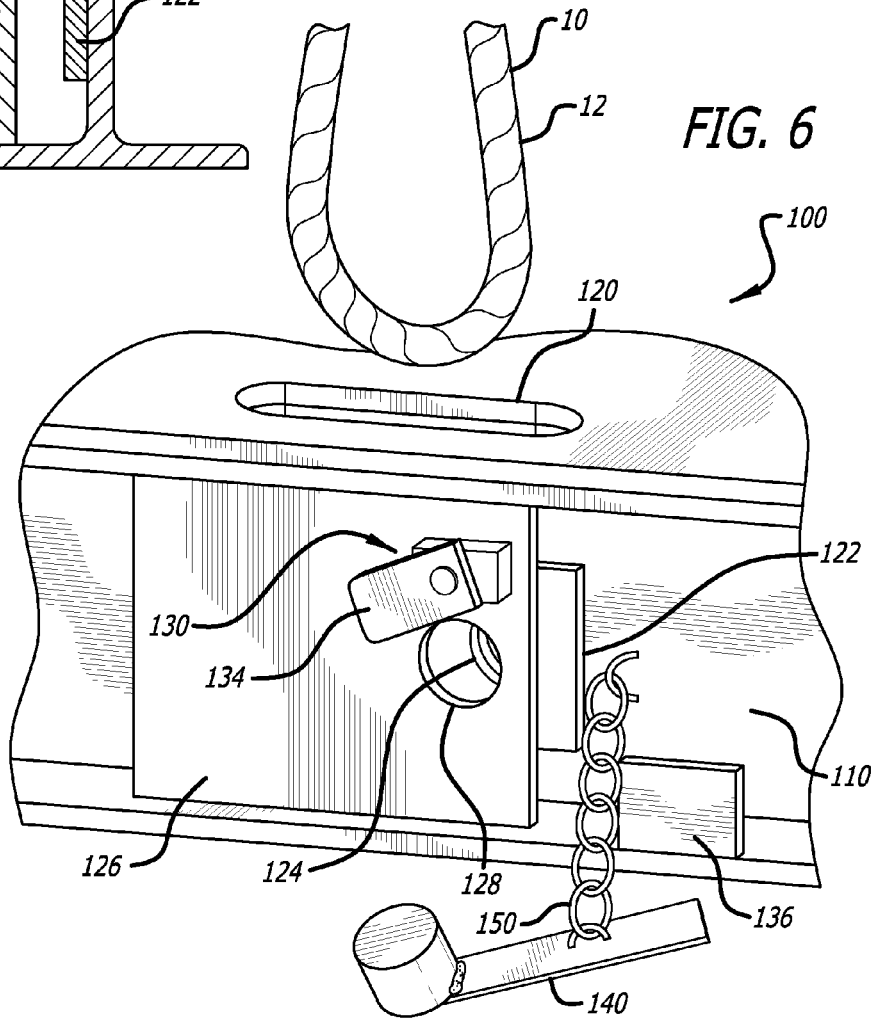
FIG. 6 is an enlarged partial perspective view of the locking assembly of FIG. 2 in a disengaged position relative to the cable.

Referring to FIG. 6, loop 12 at the end of cable 10 is positioned relative to slot 120, and removable locking member 140 is initially in a disengaged position (e.g., removed from apertures 124, 128 of first and second vertical plates 122, 126, respectively).

Figure 7:
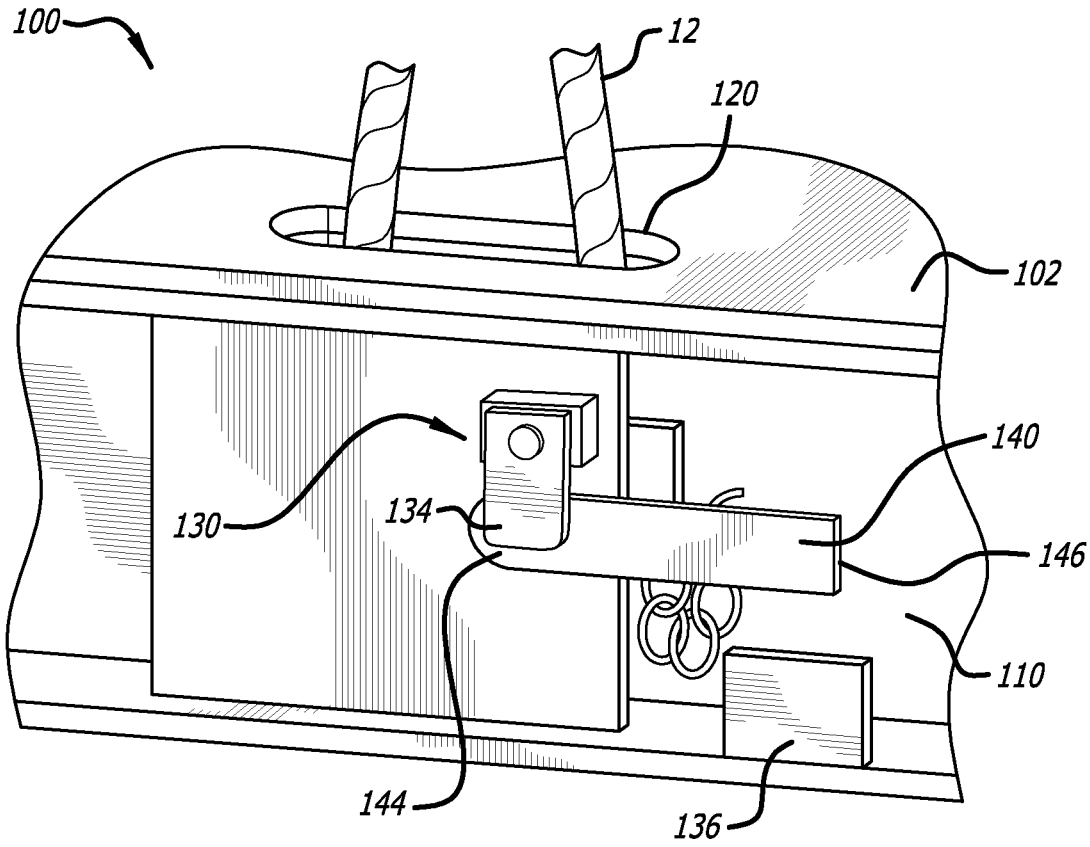
FIG. 7 is an enlarged partial perspective view of the locking assembly of FIG. 6 in an engaged position relative to the cable with a movable latch locking the removable locking member to the base.

In FIG. 7, a portion of loop 12 is inserted into slot 120 and aligned with apertures 124, 128. Removable locking member 140 is engaged with base 102 by preferably sliding peg 148 into aperture 128 of second vertical plate 126, through loop 12, and into aperture 124 of first vertical plate 122 to secure cable 10 to pallet 100 along an axis of insertion. While in this position, peg 148 preferably forms an attachment point about which cable 10 attaches to pallet 100. Movable latch 130 is rotated to move over a portion of first end 144 of removable locking member 140 to lock removable locking member 140 to base 102 and inhibit peg 148 from moving axially out of apertures 124, 128, as shown in FIG. 9.

Referring to FIG. 8, second end 146 of arm 142 is moved downwardly by rotating arm 142 about a rotation axis formed at first end 144. Preferably, the rotation axis also serves as the axis of movement of removable locking member 140 into and out of base 102. In a final position, second end 146 preferably contacts the top surface of bottom 108 and is positioned between third vertical plate 136 and sidewall 110.

Once in the position shown in FIG. 8, removable locking member 140 is double-locked, i.e., locked by movable latch 130, and locked by the placement of arm 142 and peg 148 relative to second and third vertical plates 126, 136, respectively. It is highly advantageous to double-lock removable locking member 140 to improve the safety and reliability associated with lifting heavy and valuable loads as described herein.

It will be appreciated that the steps described above may be performed in a different order, varied, or certain steps omitted entirely without departing from the scope of the present invention. For example, it will be appreciated that the positioning of second and third vertical plates 126, 136, and the interaction with removable locking member 140 may be sufficient to lock removable locking member 140 to base 102 without rotating movable latch 130. Likewise, rotation of movable latch 130 may be sufficient to lock removable locking member 140 to base 102 without the use of third vertical plate 136.

The foregoing description is by way of example only, and may be varied considerably without departing from the scope of the present invention. For example only, the base may be formed in a variety of shapes. Base 102 is preferably formed as a rectangle. However, base 102 may be formed as a square, triangle, circle or any other shape as desired. The top of the base preferably forms a horizontal plane with no projections protruding therefrom. For example, the top of the base preferably does not include any eyelifts. The top of base may have a textured surface, and may include a plurality of openings for cables. Slot 120 may be formed in a variety of shapes, or may be omitted entirely if desired. The top and/or bottom may be continuous from end to end and from side to side, or may include a plurality of parallel spaces similar to conventional pallets.

Sidewall 110 need not be inset. For example, the sidewall may be flush with the edges of the top and bottom.

First, second and third vertical plates 122, 126 and 136, respectively, are preferably parallel to one another. It will be appreciated that one or more of the vertical plates may be omitted and/or located and/or angled differently relative to one another. For example, first vertical plate 122 may be omitted by having an aperture only in sidewall 110. Third vertical plate 13$ may be omitted entirely if it is desired to rely solely on a single lock such as latch 130 to lock the cable to the pallet.

All vertical plates may be omitted if desired. For example, the base may have a peg-like projection integrally extending from the sidewall with a movable latch at its end. The loop of the cable can be moved over the peg, and the latch rotated from a twelve o'clock position to a six o'clock position to secure the cable to the pallet.

The removable locking member may be formed in a variety of ways. For example, a projection other than a peg may be used. The peg may be used alone (without an arm). A further lock may be included as part of the removable locking member itself, for example, a spring lock which can snap into engagement with the base. Chain 150, shown in FIG. 6, is optional, but preferred to minimize the risk of the removable locking member being misplaced.

The pallet may be used as a platform for a variety of cargo, including, but not limited to construction materials, automobiles and shipping containers. The pallet may be configured for use with cables not having loops if desired. For example, the cables may include fasteners to receive peg 148 to permit engagement of peg 148 therewith. Such other fasteners can include, for example, hooks, karabiners, and rings.

The features described with respect to one embodiment may be applied to other embodiments, or combined with or interchanged with the features of other embodiments, as appropriate, without departing from the scope of the present invention.

References to "front," "rear," "top," "bottom," "vertical" and "horizontal" are for illustrative convenience only as would be appreciated by a person skilled in the art.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pallet configured for hoisting by a plurality of cables, comprising:

a base including a top, a bottom opposite said top, and at least one side connecting said top and bottom, said side including at least one aperture configured to receive a prong of a forklift; and a locking assembly including a lock attached to said base for locking one of the cables to said pallet, said lock requiring an element of rotation to lock the cable to said pallet, said locking assembly including a removable member configured for removable engagement with said base, said removable member configured to cooperate with said lock and said base to lock the cable to said pallet, said removable member being configured for slideable engagement with said base.

2. The pallet of claim 1, wherein said lock is a latch.

3. The pallet of claim 1, wherein said locking assembly includes a second lock for locking the cable locked by said lock.

4. The pallet of claim 1, wherein said removable member forms an attachment point about which the cable attaches to said pallet.

5. The pallet of claim 1, wherein a portion of said removable member is configured for axial engagement into and out of said side of said base.

6. The pallet of claim 1, wherein said base includes an aperture sized and configured to receive a portion of said removable member, said portion of said removable member having an axis of rotation about which said removable member rotates when said portion of said removable member is engaged with said base.

7. The pallet of claim 6, wherein said base has a horizontal plane parallel to said top, the axis of rotation being parallel to the horizontal plane.

8. The pallet of claim 6, wherein the axis of rotation also forms an axis of movement of said portion of said removable member into and out of said base.

9. The pallet of claim 1, wherein said removable member includes an arm with a first end and a second end, said removable member including a peg at one of said ends.

10. The pallet of claim 1, wherein said lock is configured to rotate less than one full turn to lock the cable to said pallet.

11. The pallet of claim 1, wherein said top of said base forms a horizontal plane with no projections protruding thereabove.

12. The pallet of claim 11, wherein said top includes a textured surface, said top including at least one opening configured to receive one of the cables.

13. A pallet configured for hoisting by a plurality of cables, comprising;

a base including a top, a bottom opposite said top, and at least one side connecting said top and bottom, said side including at least one aperture configured to receive a prong of a forklift; and a locking assembly including a lock attached to said base for locking one of the cables to said pallet, said locking assembly including a removable member configured for removable engagement with said base, said removable member configured to cooperate with said lock and said base to lock the cable to said pallet, said lock requiring an element of rotation to lock the cable to said pallet, said base including an aperture sized and configured to receive a portion of said removable member, said portion of said removable member having an axis of rotation about which said removable member rotates when said portion of said removable member is engaged with said base, said base including a recess configured to receive a second portion of said removable member, said recess being oriented perpendicular to the axis of rotation of said removable member when said removable member is engaged with said base.

14. The pallet of claim 13, wherein said base has a horizontal plane parallel to said top, the axis of rotation being parallel to the horizontal plane.

15. The pallet of claim 13, wherein the axis of rotation also forms an axis of movement of said portion of said removable member into and out of said base.

16. A pallet configured for hoisting by a plurality of cables, comprising:

a base including a top, a bottom opposite said top, a front surface, a rear surface opposite said front surface, and opposed side surfaces, each of said side surfaces connecting said front and rear surfaces with said top and bottom to form said base, said front and rear surfaces including at least one aperture configured to receive a prong of a forklift; and a locking member having a portion configured for removable engagement with said base, said portion of said locking member forming an attachment point about which the cable attaches to said pallet, said base including an aperture sized and configured to receive said portion of said locking member, said portion having an axis of rotation about which said locking member rotates when said portion of said locking member is engaged with said base, said base including a recess configured to receive a second portion of said locking member, said recess being oriented perpendicular to the axis of rotation of said locking member when said locking member is engaged with said base.

17. The pallet of claim 16, wherein the axis of rotation also forms an axis of movement of said portion of said locking member into and out of said base.

18. A method for hoisting a pallet, comprising:

positioning the pallet with a fork lift to a location for subsequent lifting of the pallet by a hoist having a plurality of cables, each cable including an end with a loop;

attaching each cable to the pallet by inserting a locking member through the end loop of the cable and into the pallet to secure each cable to the pallet;

rotating a lock over a portion of the locking member to inhibit axial movement of the locking member out of the pallet; and hoisting the pallet once the cables have been secured to the pallet.

19. The method of claim 18, wherein the attaching includes:

sliding a portion of the locking member into the pallet; and rotating the locking member once the portion of the locking member is slideably received in the pallet.

20. A pallet comprising:

a top plate, a bottom plate, a first side plate, and a second side plate, said first and second side plates spacing said top plate and said bottom plate apart from one another;

at least one aperture formed through the pallet, said at least one aperture adapted to receive a prong of a fork lift; and at least four cable locking assemblies, two of said four cable locking assemblies provided adjacent said first side plate and two of said four cable locking assemblies provided adjacent said second side plate, each of said at least four cable locking assemblies including a face plate spaced from a respective one of said first side plate and said second side plate, a cavity formed between said face plate and said respective one of said first side plate and said second side plate, a first opening formed through said face plate and a second opening formed through said respective one of said first side plate and said second side plate, said first and second openings being axially aligned with one another, a peg sized to fit into said first and second openings and through an end of a cable received in said cavity, and a latch adapted to retain said peg in said first and second openings, wherein, when inserted into said first and second openings and through the end, said peg serves to pin the cable in said cavity.

* * * * *